United States Patent [19]
Ahn et al.
[11] 4,306,907
[45] Dec. 22, 1981

[54] AGE HARDENED BERYLLIUM ALLOY AND CERMETS

[75] Inventors: Byong-Ho Ahn, Wayland; Dilip K. Das, Bedford; Kaplesh Kumar, Wellesley, all of Mass.

[73] Assignee: Charles Stark Draper Laboratory, Inc., Cambridge, Mass.

[21] Appl. No.: 136,599

[22] Filed: Sep. 12, 1980

Related U.S. Application Data

[62] Division of Ser. No. 25,286, Mar. 29, 1979, abandoned.

[51] Int. Cl.[3] ..... C22C 25/00; C22C 32/00

[52] U.S. Cl. ..... 75/150; 75/235; 75/250; 75/951; 148/126

[58] Field of Search ..... 148/126; 75/150, 950, 75/951, 235, 244, 249, 250

[56] References Cited

U.S. PATENT DOCUMENTS

| | | | |
|---|---|---|---|
| 2,607,676 | 8/1952 | Kurtz | 75/241 |
| 3,117,001 | 1/1964 | Crossley | 75/150 |
| 3,129,497 | 4/1964 | Johnston et al. | 75/150 |
| 3,264,147 | 8/1966 | Bonfield et al. | 148/158 |
| 3,579,390 | 5/1971 | Paine | 148/126 |
| 3,581,231 | 5/1971 | Freiberg | 75/150 |

OTHER PUBLICATIONS

Kaufmann et al., "Beryllium-Rich Alloys", The *Metal Beryllium* ASM, Cleveland, Ohio, 1955, pp. 555-598.

Reed-Hill, *Physical Metallurgy Principles*, Van Nostrand Reinhold Company, N.Y., 1964, p. 247.

*Primary Examiner*—Peter K. Skiff
*Attorney, Agent, or Firm*—Weingarten, Schurgin & Gagnebin

[57] ABSTRACT

Process for the formation of precipitation hardened beryllium-nickel, beryllium-iron, and beryllium-cobalt alloys and cermets for structural and bearing use respectively in precision instruments and such alloys and cermets. A beryllium-nickel, -iron, or -cobalt high solute solution at elevated temperature is rapidly cooled to provide a readily machined solid solution. After machining, the alloy is reheated to an intermediate temperature under controlled conditions where precipitation hardening occurs through limited precipitate cluster formation. A cermet is formed in the process with the addition of a ceramic material to the beryllium alloy in the initial steps.

2 Claims, 3 Drawing Figures

AGE HARDENED BERYLLIUM ALLOY AND CERMETS

This is a division of application Ser. No. 25,286 filed Nov. 29, 1979 now abandoned.

FIELD OF THE INVENTION

This invention relates to the formation of age hardened beryllium alloys and cermets.

BACKGROUND OF THE INVENTION

Because of its low-density, high strength and toughness, beryllium is used widely in the manufacture of structural elements in precision inertial guidance instruments. For bearings for supporting rotating elements in such applications, beryllium is often coated with a ceramic layer for the load handling surface.

In such applications, high micro-yield strength of the beryllium structural element is desired along with toughness, and machining ease.

The micro-yield strength of beryllium has previously been improved by dispersion strengthening which may be achieved by a distribution of beryllium oxide particles within the beryllium matrix. The oxide particles of this material, however, become dislodged from their sites in the metal during the polishing process or in use and produce undesirable scratches on the surface of the beryllium element. Also, theory predicts that the strength properties of the beryllium element, thus produced, could be improved.

In the case where a ceramic coating is used either alone or with beryllium for precision bearings or other load handling applications, not only are machining, toughness and strength factors of interest, but thermal conductivity and expansion, friction, magnetic properties, and porosity become important. Ceramics typically have far lower thermal conductivity than the pure metal counterpart which impedes the removal of heat from the source at the bearing interfaces. Because the ceramic has a different thermal expansion coefficient from the pure metal which often constitutes the instruments structural members, instrument accuracy is reduced. Ceramics including nickel or iron tend to be magnetic and thus contribute to noise in the electromagnetic circuitry of inertial instruments. Sputtering or plasma spraying is commonly used to produce ceramic deposits on beryllium for bearings, due to the difficulty in mechanically forming ceramic elements. Sprayed layers are porous which, in the case of air bearings, causes a loss of bearing air pressure and stiffness, and, further, sputtered surface bearings suffer from anomalies in composition and adhesion which promote friction and high wear.

BRIEF SUMMARY OF THE INVENTION

In accordance with the teaching of the present invention an age hardened beryllium alloy is developed for use in structural elements of precision instruments and, with the addition of a ceramic, for use as bearings in such instruments. The age hardening process is controlled to produce a substantial improvement in micro-yield strength without relying on oxides which have the attendent difficulties discussed above. In addition, prior to the age hardening step, the alloy exhibits a soft mechanical structure which permits ease of machining to the final configuration.

In the case of a metal alloy, the metals involved may be combined either by melting together or by subjecting powders to cold and hot pressing techniques resulting ultimately in the production of a metal alloy at high, typically over 900° C., temperatures. The high temperature permits a high solubility of the alloying metal or solute in the base metal which is then converted into a single phase alloy by rapid cooling to inhibit precipitation. The rapidly cooled alloy exhibits a relative softness which permits ease of machining as discussed above. The machined and formed alloy is then heated to an intermediate temperature with the specific temperature and time controlled to achieve a desired degree of precipitation of excess solute material. At the lower temperature the solute has a lower solubility in the base metal thus promoting the precipitation of the solute at a temperature where precipitation is possible. Solute atoms thus lost from the alloy solution precipitate into uniformly dispersed clusters of atoms which is limited by time and temperature to initial stages of cluster formation to produce desired coherency strains in the surrounding alloy lattice structure. This in turn prevents dislocation motion and slip, strengthening the overall alloy. For the purposes of using the alloy as a bearing, a ceramic material is added to the solute and base metal mixture for the initial consolidation or mixing stages and subsequently treated in substantially the same manner with the time and temperature parameters of age hardening controlled for the specific properties desired in the resulting cermet or ceralloy as it may be called.

DESCRIPTION OF THE DRAWING

These and other features of the present invention are more fully setforth below in the solely exemplary and non-limiting detailed description and accompanying drawing of which.

DETAILED DESCRIPTION OF THE INVENTION

The present invention contemplates a method for the formation of an age hardened material in an alloy or alloy-ceramic form which includes an intermediate stage in which the material may be readily machined or otherwise worked, and the product formed thereby. More specifically the invention is related to the formation of a beryllium alloy with nickel, iron or cobalt and the alloy in combination with a ceramic material. A solution of the beryllium and solute is achieved with a high solute percentage at high temperatures at which the solubility of solute in beryllium is greater than at lower temperatures. The heated alloy or alloy-ceramic is then rapidly cooled to inhibit precipitation of the solute as the solubility decreases with temperature resulting in a soft, single phase alloy which is readily machined. Subsequent intermediate temperature age hardening with precipitation limited to the formation of small, initial clusters of a beryllium-nickel, beryllium-iron, or beryllium-cobalt compound increases strength and hardness, and reduces micro structure slippage and creep.

The reduced presence of beryllium oxide as a precipitate for hardening and strengthening purposes avoids the potential for oxide dislodging resulting in surface scratching of highly polished surfaces. In addition the control exercisable over precipitate formation through temperature and time variation permits lattice strengthening to match the characteristics of the alloy or alloy-ceramic to the strength requirements of the application. Variation in solute and/or ceramic concentrations will vary the other properties noted above.

Figure 1:
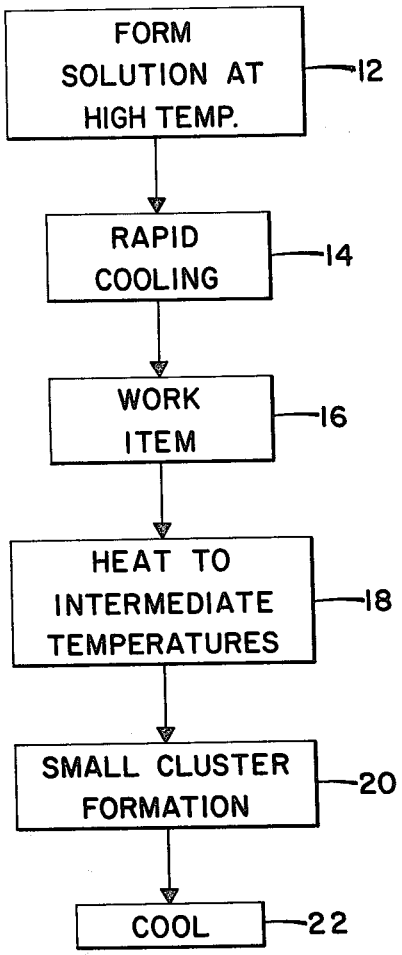
FIG. 1 is a processing diagram for producing a mechanically formed, age hardened element in accordance with the present invention.

More particularly in practicing the present invention, as illustrated in FIG. 1, in an initial step 12 a heated solution is provided of beryllium alloyed with nickel, iron, or cobalt or such alloy in combination with a ceramic such as titanium diboride. The solution is established at an elevated temperature which in the case of a beryllium nickel alloy is in the range of 900° C. to 1240° C. at which the solubility of nickel in beryllium is very high, approximately 20 weight percent. In the case of beryllium-iron and beryllium-cobalt alloys the pertinent temperatures are 900° C. to 1225° C. and 900° C. to 1245° C. respectively at which solutions of close to 4 and approximately 20 weight percent of iron and cobalt respectively in beryllium is achieved.

The elevated temperature of step 12 is maintained for typically over an hour. Thereafter, in a step 14 the alloy or alloy-ceramic is rapidly cooled to room or working temperature such as by drawing it into a cold zone or quenching it in a low temperature fluid medium. Cooling is achieved within a period of generally less than a few seconds to insure that the high temperature alloy converts to a single phase solid alloy without substantial precipitation of excess nickel, iron or cobalt which can occur at intermediate temperatures between the elevated temperature of step 12 and room temperature. The rapid cooling step 14 produces a relatively soft alloy or alloy ceramic which can be worked, as in an optional step 16, to desired configurations such as those required in structural members or bearings in precision gyroscopes for inertial navigation systems.

The cooled or cooled and worked item is subsequently heated to an intermediate temperature in a step 18. In the case of both beryllium-nickel, -iron and -cobalt alloys and alloy ceramics the intermediate temperature is in the range of 200° C. to 900° C. and that temperature is maintained for a few minutes to several days depending on temperature and degree of strengthening desired. The purpose of the intermediate temperature step is to permit precipitation of excess solute from the beryllium alloy. In the case of beryllium nickel the excess nickel appears generally as a $Ni_5Be_{21}$ precipitate. Precipitation is continued to the point of initial cluster formation only so as to form small clusters of solute atoms, uniformly dispersed as a large number of fine precipitates in the alloy matrix. The many fine atom clusters introduce coherency strains into the surrounding lattice structure that prevents dislocation motion and slippage. There results a strengthening of the alloy in both micro-yield and micro-creep, as well as an increase in material toughness. The duration of cluster formation in step 20 may be varied thereby, in conjunction with the temperature to which the alloy is elevated in step 18, providing control over the degree to which cluster formation proceeds and lattice coherency strains are established.

Subsequent to step 20, the alloy is cooled in step 22 down to room or use temperature at which a fully machined, age hardened material of substantial strength and toughness is provided.

In the case where the beryllium alloy-ceramic is employed, the control over temperature and time in steps 18 and 20 also controls cermet strength. Other properties such as thermal conductivities, expansion coefficient, and other physical properties of interest to the load bearing final product are more a function of the percent of solute or ceramic in the hardened product. In addition, because of the homogeneity of the product in the ceramic or cermet case, porosity and surface anomalies are not present as is the case with plasma sprayed or sputtered ceramic surfaces.

Figure 2:
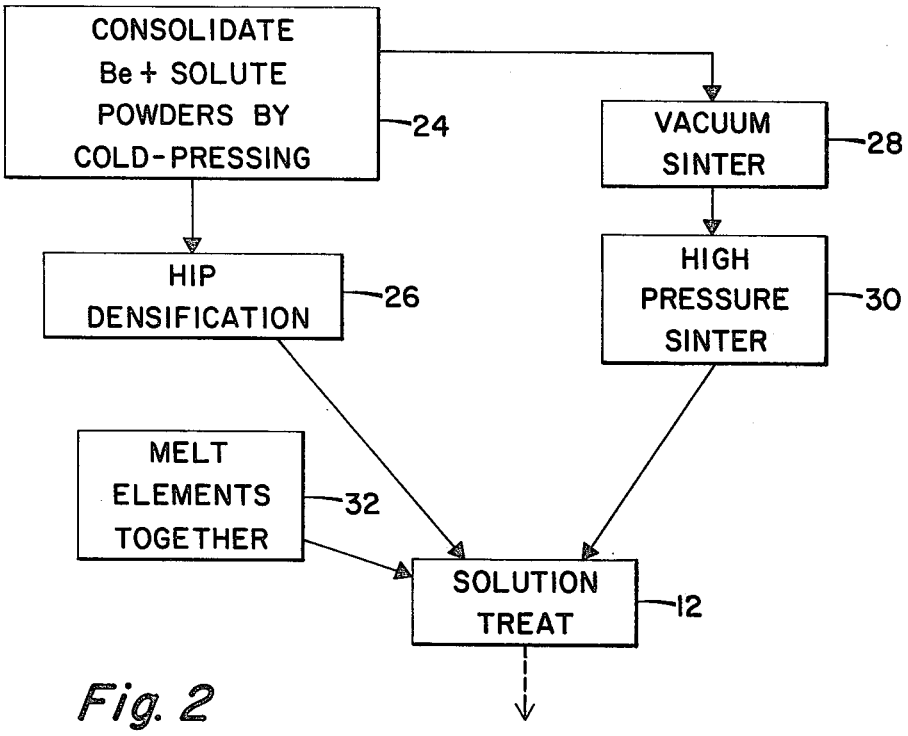
FIG. 2 is a processing diagram illustrating the formation of an alloy solution for use as the starting material in the process of FIG. 1.
Figure 3:
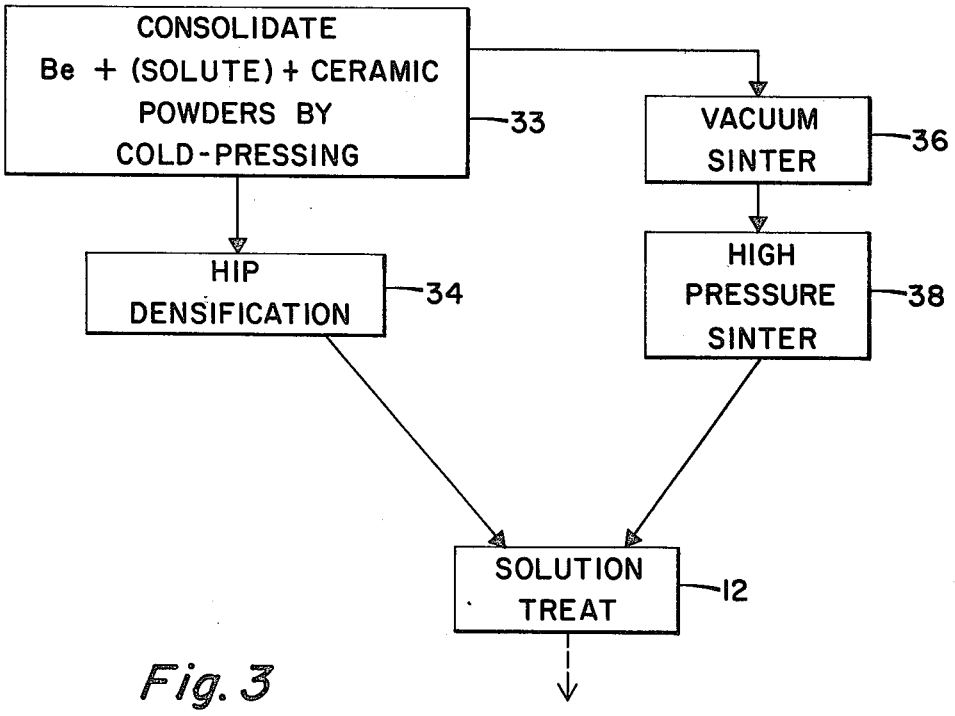
FIG. 3 is a processing diagram illustrating the formation of an alloy-ceramic (ceralloy) combination for use as a starting material in the process of FIG. 1.

The preparation of the initial alloy or alloy-ceramic is illustrated respectively in FIGS. 2 and 3. In FIG. 2 an initial step 24 may be utilized for consolidation of beryllium and nickel, iron, or cobalt powders in ratios according to the desired alloy mixtures described above. Initial consolidation is typically achieved by cold pressing techniques such as by conventional die pressing or cold isostatic pressing. The material thus compacted may then be further densified in a hot isostatic pressing step 26 to close to 100% density, again using known technology to achieve this level of densification. The densified product is then subjected to the high temperature alloy solution treatment step 12 discussed above with respect to FIG. 1. Optionally the powder mixture may be simply subjected to the hot isostatic processing of step 26 before solution treatment in step 12.

Alternatively, after the initial consolidation step 24, sintering techniques may be used for further densification. First a low pressure sintering step 28 is provided for initial densification without trapping gas molecules within the closed pore structure resulting from the initial sintering step 28. A subsequent high pressure sintering step 30 is employed at an elevated pressure of, for example 100–15,000 psi to produce further compaction once the internal spaces are sealed in the initial sintering step 28. The product of the high pressure sintering step 30 is then treated in accordance with the alloying step 12 noted above. be directly melted together in a step 32 in the desired ratios and the melt subjected to the solution treating step 12.

In the case where a cermet is desired in the final product, and as illustrated in FIG. 3, an initial consolidation step 33 includes cold pressing of beryllium, nickel (or iron or cobalt) and ceramic, for example, titanium diboride, powders by the cold pressing techniques discussed above. The ceramic is provided in the ratio of 30 to 60 volume percent to alloy material. Subsequent to the consolidation step 33, a hot isostatic pressing densification step 34 may be employed to achieve a densification sufficient to permit the solution treating step 12 to be employed. Also as indicated above, the densification step 34 may be practiced alone on the mixed powders of beryllium, solute and the desired ceramic. The hot isostatic pressing densification is employed typically to achieve a near 100% density of the material. Other ceramics which may be used include titanium carbide, titanium nitride, tantalum carbide, zirconium carbide, vanadium carbide, aluminum oxide, chromium oxide, tantalum oxide, silicon nitride, boron nitride, and boron carbide. In general ceramics which are not reduced by beryllium at the temperature of the process may be used. After the consolidation step 33, sintering steps 36 and 38, as discussed above with respect to FIG. 2, may also be employed as an optional route to achieving a nearly 100% densified product for the solution treating step 12.

Alternatively, the cermet for these applications may be formed from the process of FIG. 3 using beryllium of typically less than 30 micron grain size and a ceramic alone. The ceramic normally is used in a 30–60 volume % ratio. In this case, the product of the HIP or sintering steps 34 or 38 is the final use product.

The above detailed description of the invention is intended to be exemplary only of the manner in which it may be practiced, the specific scope of the invention being solely as indicated in the following claims.

What is claimed is:

1. A process for the formation of a cermet for use as a bearing in precision instruments comprising the steps of:

consolidating powders consisting of beryllium and a non-beryllium based ceramic selected from the group consisting of titanium diboride, titanium carbide, titanium nitride, tantalum carbide, zirconium carbide, vanadium carbide, aluminum oxide, chromium oxide, tantalum oxide, silicon nitride, boron carbide and boron nitride in a ratio of 30 to 60 volume percent ceramic by cold processing; and densifying the consolidated powders by hot isostatic pressing.

2. A beryllium cermet product formed in accordance with the process of claims 1.

* * * * *

UNITED STATES PATENT AND TRADEMARK OFFICE

CERTIFICATE OF CORRECTION

PATENT NO. : 4,306,907

DATED : December 22, 1981

INVENTOR(S) : Byong-Ho Ahn, et al

It is certified that error appears in the above—identified patent and that said Letters Patent is hereby corrected as shown below:

Front page, left hand side, line [21], "Appl. No.: 136,599" should read --Appl. No.: 186,599--.

Column 1, line 6, "Nov. 29, 1979" should read --March 29, 1979--.

Column 4, line 43, "12 noted above. be directly melted together in a step 32" should read --12 noted above.
(new paragraph)
Alternatively, the two elements desired to be combined in alloy form may be directly melted together in a step 32--.

Signed and Sealed this

Tenth Day of August 1982

[SEAL]

Attest:

GERALD J. MOSSINGHOFF

Attesting Officer

Commissioner of Patents and Trademarks